US005381633A

United States Patent [19]

Hendrich

[11] Patent Number: 5,381,633

[45] Date of Patent: Jan. 17, 1995

[54] ASSEMBLY AND METHOD FOR CONSTRUCTING A BUILDING

[76] Inventor: John H. Hendrich, 318 S. Fairfax St., Alexandria, Va. 22314

[21] Appl. No.: 43,981

[22] Filed: Apr. 7, 1993

Related U.S. Application Data

[63] Continuation of Ser. No. 589,527, Sep. 28, 1990, abandoned.

[51] Int. Cl.[6] ..... E04B 2/00

[52] U.S. Cl. ..... 52/71; 52/64; 52/79.5; 52/235; 52/745.11; 52/745.16

[58] Field of Search ..... 52/69, 70, 71, 79.5, 52/69, 70, 71, 79.5, 79.8, 64, 235, 272, 745.02, 745.05, 745.11, 745.13, 745.16

[56] References Cited

U.S. PATENT DOCUMENTS 3,832,811 9/1974 Briel, Jr. ..... 52/69
3,849,952 11/1974 Hanaoka ..... 52/79
4,162,595 7/1979 Ramos et al. ..... 52/69
4,633,626 1/1987 Freeman et al. ..... 52/71
4,696,132 9/1987 LeBlanc ..... 52/69

*Primary Examiner*—Carl D. Friedman
*Assistant Examiner*—Robert J. Canfield
*Attorney, Agent, or Firm*—Finnegan, Henderson, Farabow, Garrett & Dunner

[57] ABSTRACT

An assembly is provided for constructing a building, which can be used to construct a high rise building. A building assembly unit is prefabricated in a factory, and is transported to a construction site. The unit includes a floor member and a pivotably connected wall member, which may be an exterior or interior wall. Electrical wiring, plumbing, ventilation, doorways, windows, and so forth may be pre-installed in the factory. Each unit is configured to be installed on a support structure, which may be a high rise support structure. Each unit is connected to the support structure, and to a proximate unit.

22 Claims, 5 Drawing Sheets

ASSEMBLY AND METHOD FOR CONSTRUCTING A BUILDING

This application is a continuation, of application Ser. No. 07/589,527, filed Sep. 28, 1990, now abandoned.

BACKGROUND OF THE INVENTION

1. Field of the Invention

The present invention relates to an assembly and method for constructing a building. More specifically, the invention relates to an assembly and method for constructing one-story, multi-story, and high rise buildings, using building assembly units assembled away from the building site, and transported to the site in a folded configuration for installation on a support structure.

2. Description of the Related Art

Systems building assemblies and techniques are known in the construction industry. Systems building assembly techniques typically involve erecting a structure using factory-assembled modules. A great deal of the assembly work can be performed at the factory in a controlled environment, with the resultant module transported to the construction site for final assembly. This technique frees the building contractor from relying on on-site skilled labor, favorable weather conditions, and so forth. Therefore, systems building assembly techniques save substantial time and money.

A preferable systems building technique involves use of folded building assemblies. Previous folded building assemblies and methods, however, have only proved advantageous in constructing small buildings, such as residential structures. For example, foldable houses, A-frames, and the like have been manufactured and sold successfully and profitably. However, previous folded building assembly concepts have been unsuccessful when applied to construction of multi-story buildings, such as high rise apartments, shopping malls, or office buildings.

This failure can be attributed to several causes. A key problem is that foldable modular assemblies, which have been successfully utilized in the residential housing industry, cannot bear sufficient load for use in a high rise building. Therefore, another systems building approach using another type of prefabricated assembly is required.

One systems building approach which has been attempted involves use of a prefabricated cell. The cell assembly includes a concrete or steel rectangular structure including floor, ceiling, and wall panels. Multiple cells are stacked or placed in a support frame to create a multi-story building. This system is disadvantageous, however, in that the resultant building interior is extremely uniform and "boxy", lacking in aesthetic versatility. Moreover, the cells are difficult and expensive to transport to the construction site. On-site staging and storage requires considerable space and handling expense. Thus, the cell assembly system has not been a viable solution.

Another related building approach uses prefabricated panels. A plurality of panels, precast with window and door apertures, are manufactured in the factory. The plurality of panels are then transported to the construction site, and mounted on a preexisting support frame. Different panels function as floors, ceilings, and walls. The panel building can have much more versatility than the cell building described above. However, each panel must be lifted into place by an on-site crane. Since installation of each panel equates to one lift of the crane, it is easy to see that the rate of construction of the building is limited by the number of available cranes. In practice, this real-world limitation has proven to be an extremely significant factor. The requirement to lift each panel into place slows construction, resulting in increased construction costs. The end result is that the panel system is not a viable option.

A new building approach is thus desirable for use in constructing a building, particularly a high rise building.

Accordingly, it is an object of the present invention to provide an assembly and a method for constructing a building.

It is also an object of the invention to provide an assembly and method suitable for constructing a single-story, multi-story, or high rise building.

It is further an object of the invention that the assembly include components which can be prefabricated in the factory and transported easily to the construction site.

It is further an object of the invention that the assembly require minimum storage at the construction site.

It is further an object of the invention that the prefabricated portions be configured to be set in place in a support frame without requiring excessive use of an on-site crane.

Additional objects and advantages of the invention will be set forth in the description which follows, and in part will be learned by practice of the invention. The objects and advantages of the invention may be realized and obtained by means of the combinations particularly pointed out in the appended claims.

SUMMARY OF THE INVENTION

To achieve the foregoing objects, and in accordance with the purposes of the invention as embodied and broadly described herein, an assembly for insertion into a support structure for constructing a building is provided. The building assembly unit includes a generally rectangular first planar member, configured to be installed horizontally or inclined upon the support structure to define a floor member, having opposite surfaces and opposite edges, and a generally rectangular second planar member having opposite surfaces and opposite edges pivotally attached proximate one edge of the first planar member at a point intermediate said opposite edges of the second planar member, which pivots downward away from the floor member to a generally vertical position to define a wall member.

The assembly further includes a third planar member pivotably attached to a surface of the first planar member, intermediate the opposite edges of the first planar member which pivots away from the floor member to define another wall member.

The first, second and third planar members include means for providing electricity, plumbing, and ventilation. They also include precut apertures for installation of doors, windows, or other means of access.

The assembly further includes means for connecting the building assembly units to the support structure.

The assembly further includes a plurality of the above described building assembly units. A plurality of first planar members can be connected to form a common floor member. Connecting means connect adjoining floor members together. Other connecting means also connect adjoining wall members together.

In a multi-story or high rise building, a plurality of building assembly units are used to define a floor member, and wall members for the floors above and below the floor member.

Prior to building construction, the building assembly units are disposed to fold, with the first and second planar members in parallel abutting relationship, for transport to the construction site.

BRIEF DESCRIPTION OF THE DRAWINGS

The accompanying drawings, which are incorporated in and constitute a part of the specification, illustrate a preferred embodiment of the invention, and together with the general description given above and the detailed description of the preferred embodiment given below, serve to explain the principles of the invention.

FIG. 1A is a partial side view of a building assembly unit according to the present invention, having first and second planar members pivotably connected;

FIG. 1B is a partial side view of another embodiment of a building assembly unit according to the present invention;

FIG. 1C is a partial side view of yet another embodiment of a building assembly unit;

DESCRIPTION OF THE PREFERRED EMBODIMENTS

Reference will now be made in detail to the present preferred embodiments of an assembly for constructing a building as illustrated in the accompanying drawings.

The present invention relates to an assembly unit configured to be installed in and attached to a support structure for constructing a building. The support structure, which may be separately provided, may include any conventional support structure used in the construction industry. As broadly embodied in FIG. 13, a support frame 50 is provided, consisting of a plurality of framing members 52 defining a frame. Framing members 52, which may be, for example, beams or columns, are typically made of steel, wood, or concrete. The invention is not limited to use in a frame as its support structure however. Any structure which can support a multi-story building is contemplated, including an adjoining building.

In accordance with the invention there is provided a building assembly unit. The building assembly unit includes a first planar member configured to be installed on the support structure to define a floor member, and a second planar member pivotably attached proximate one edge of the first planar member, and means for pivoting the second planar member to a generally vertical position to define a wall member.

As broadly embodied herein, referring to FIG. 1A, building assembly unit 60 includes a generally rectangular first planar member 62. Rectangular first planar member 62, which will comprise a floor member when installed on support frame 50, is constructed according to any of the conventional methods for constructing flooring which bears loads. Rectangular first planar member 62 can be installed horizontally or on an incline, as desired.

Figure 2C:
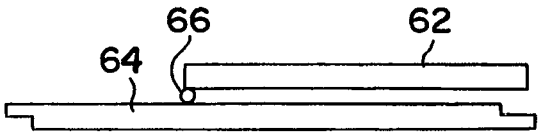
FIG. 2C is a partial side view of the embodiment of FIG. 1C, depicting the second planar member pivoting away from the first planar member.
Figure 2C:
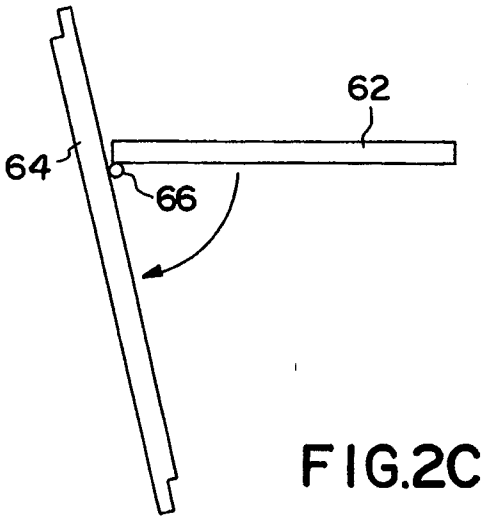
Figure 2B:
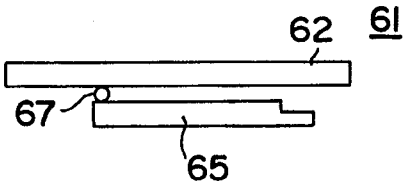
FIG. 2B is a partial side view of the embodiment of FIG. 1B, depicting the second planar member pivoting away from the first planar member.
Figure 2B:
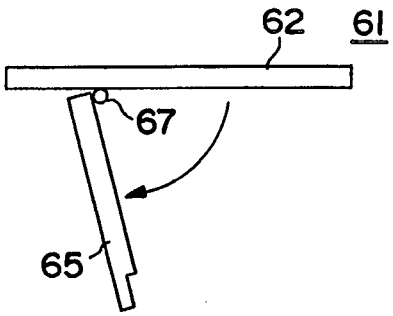
Figure 2A:
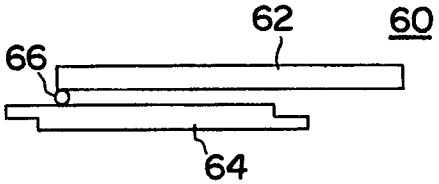
FIG. 2A is a partial side view of the embodiment of FIG. 1A, depicting the second planar member pivoting away from the first planar member.
Figure 2A:
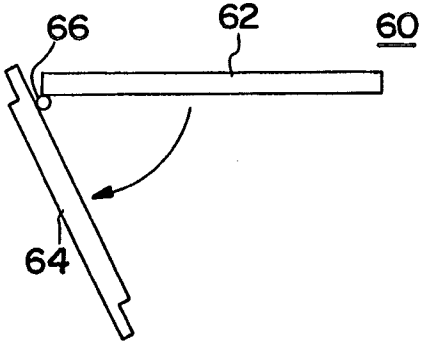

Building assembly unit 60 includes a generally rectangular second planar member 64, pivotably connected to first planar member 62 at pivotal connection point 66. As embodied in FIG. 1A, connection point 66 is proximate one edge of first planar member 62, and intermediate two edges of second planar member 64. In this configuration, second planar member 64 is disposed to pivot into position against the outer edge of first planar member 62, and serves as an exterior wall of the building, as shown in FIG. 2A.

An alternate building assembly unit 61 can also be configured as shown in FIG. 1B. In this configuration, a second planar member 65 is pivotably connected to a first planar member 62 at a pivotal connection point 67. As embodied in FIG. 1B, connection point 67 is proximate one edge of second planar member 65, and intermediate two edges of first planar member 62. Second planar member 65 is disposed to pivot into position and also serve as an exterior wall of the building, as shown in FIG. 2B. When used in combination with building assembly unit 60, building assembly unit 61 provides the builder increased flexibility, since exterior walls of the building on successive stories can be staggered or offset, producing an aesthetically pleasing effect.

Second planar members 64 and 65 can be constructed as load bearing members, or as non-load-bearing "curtain walls" by techniques known in the art.

Figure 1D:
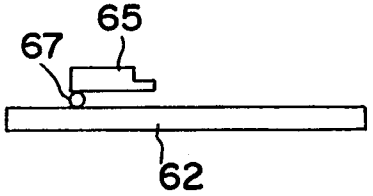
FIG. 1D is a partial side view of yet another embodiment of a building assembly unit.

Building assembly units 60 and 61 can also be configured as shown in FIGS. 1C and 1D.

As embodied in FIG. 1C, second planar member 64 is configured double the length depicted in FIG. 1A. In this configuration, second planar member 64 pivots into position against the outer edge of first planar member 62, and serves as an exterior wall for the stories above and below first planar member 62, as shown in FIG. 2C.

Figure 2D:
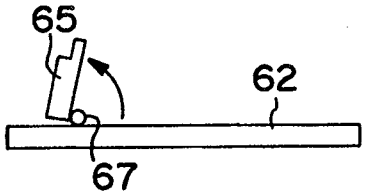
FIG. 2D is a partial side view of the embodiment of FIG. 1D, depicting the second planar member pivoting away from the first planar member.

As embodied in FIG. 1D, second planar member 65 pivots into place against the surface of first planar member 62 to serve as the wall or railing of a balcony, as shown in FIG. 2D.

It is to be understood, and can be seen in FIGS. 1A–1D and 2A–2D, that second planar members may be connected to either surface of first planar member 62. The invention is not limited to a connection point on a single surface of first planar member 62.

Figure 3:
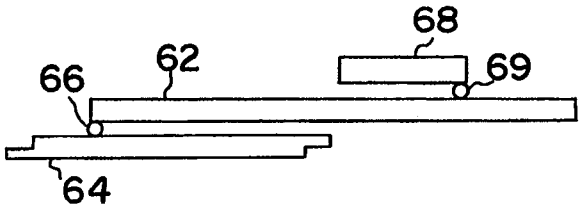
FIG. 3 is a partial side view of a building assembly unit according to the present invention, having first, second, and third planar members pivotably connected.
Figure 4:
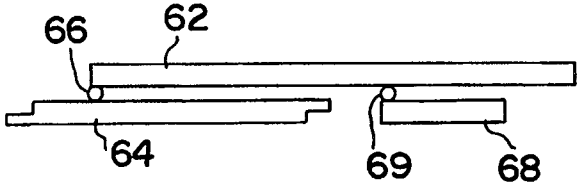
FIG. 4 depicts an alternate embodiment of the building assembly unit of FIG. 3.

In accordance with the invention, a third planar member can be pivotably connected to the first planar unit. As embodied in FIGS. 3 and 4, a generally rectangular third planar member 68 is pivotably connected at connection point 69 to first planar member 62. Third planar member 68 is connected with connection point 69 proximate one edge of third planar member 68 and intermediate two opposite edges of first planar member 62. In this configuration, third planar member 68 is disposed to pivot to a position relative to first planar member 62 to define an internal wall. In FIG. 3, third planar member 68 is connected to the opposite surface of first planar member 62 relative to second planar member 64. In FIG. 4, third planar member is connected to the same surface as second planar member 64.

Figure 5:
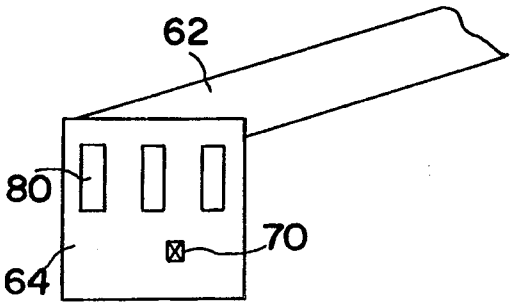
FIG. 5 is a perspective view of the building assembly unit of FIG. 1A.
Figure 6:
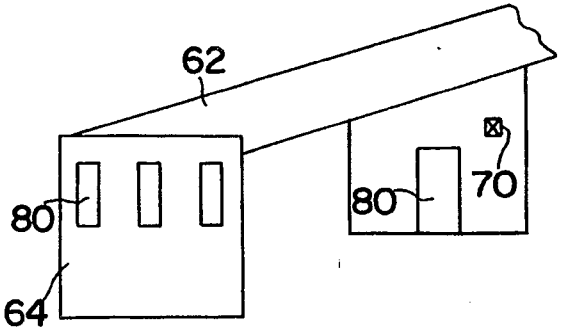
FIG. 6 is a perspective view of the building assembly unit of FIG. 4.

Preferably, first, second and third planar members include means for supplying electricity, plumbing, and ventilation as required. As embodied in FIGS. 5 and 6, reference numeral 70 broadly represents any conventional means for supplying these loads to the building, including but not limited to electrical wiring, electrical outlets, plumbing and ventilation piping, and the like. These items can be pre-installed at the factory, and thus can be already in place when the building assembly unit is installed.

Preferably, first, second and third planar members also include means for providing access through the planar members as required. As embodied in FIGS. 5 and 6, reference numeral 80 broadly represents any conventional access means through a floor or wall, including but not limited to doorways, windows, ventilation ducts, and so forth. These items can be preinstalled at the factory.

It is to be understood that planar members 62, 64, 65, 68 are not limited to single rectangular planar members. Rather, they may comprise double planar members of wood, steel, drywall or the like, defining a void space therebetween. The void space may be filled with material such as concrete, urethane, styrene, or other expanding foam, or insulation. Alternately, each planar member may comprise a series of parallel beams connected together to define a framework, having surface structures of wood, steel or concrete on each side.

The pivotal nature of the planar members 62, 64, 65, 68 enables each building assembly unit 60 to be folded, as embodied in FIGS. 3 and 4. Due to the compact nature of the folded building assembly units 60, 61, several such units can be transported together in each shipment to the construction site.

In accordance with the invention, means are provided for connecting the building assembly unit to the support structure. The connecting means provide structural integrity to the building. The connecting means may include mechanical unions. As broadly embodied in FIG. 7, mechanical union 90 connects first planar member/floor member 62 to framing member 52. Mechanical union 90 may be any conventional mechanical device, including nails, bolts, clamps or the like.

Figure 7:
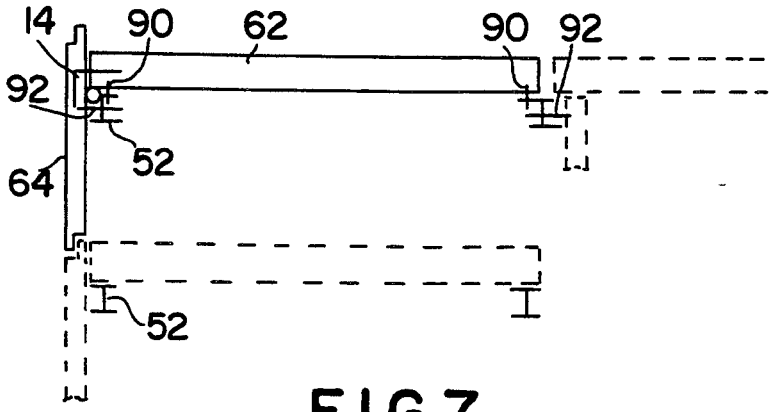
FIG. 7 is a partial side view of the building assembly unit of FIG. 1A, depicting the first planar member installed on a support structure to define a floor member, and the second planar member pivoted to define a wall member, and various connecting means according to the present invention.

As broadly embodied herein, a similar mechanical union may connect the second planar member/wall member to a framing member. Referring to FIG. 7, mechanical union 92 connects second planar member/wall member 64 to framing member 52. Once again, mechanical union 92 may include any conventional mechanical device.

It is further preferable that means be provided for connecting the wall member to the floor member. As broadly embodied in FIG. 7, mechanical union 94 is inserted to rigidly join second planar member/wall member 64 to first planar member/floor member 62. Once again, mechanical union 94 may include any conventional device. A preferred union is a bent reinforcing bar (rebar) inserted between the members and fixed into place by pouring concrete into the void space in second planar member/wall member 64, and also pouring concrete on the first planar member to define a floor or roof slab. Bolts, clamps, welds, and the like are also within the scope of mechanical union 94.

Figure 8:
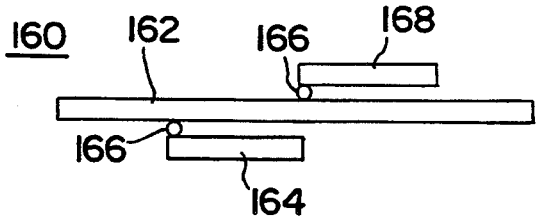
FIG. 8 depicts an embodiment of a building assembly unit according to the present invention having second planar members which form only interior walls.

In accordance with the invention, an alternate interior building assembly unit 160 is provided, broadly configured as shown in FIG. 8 and described below. Building assembly unit 160 includes a first planar member 162 and a second planar member 164 broadly configured as described above for building assembly units 60 and 61. However, in alternate building assembly unit 160, second planar member 164 is pivotably attached to first planar member 162 at connection point 166, which is positioned intermediate two opposite ends of first planar member 162. Second planar member 164 can fold up against first planar member 162 for transport, then pivot away to define an interior wall member.

Preferably, alternate building assembly unit 160 can be configured with third planar assemblies 168 pivotably attached on either surface, intermediate two opposite ends.

In accordance with the invention, the assembly for constructing a building includes a plurality of the above-described building assembly units. The number of building assembly units 60, 61, and 160 required will be dependent on the size of the particular building. Furthermore, each building will include a number of building assembly units 60, 61, and 160, as desired, each configured to provide a plurality of floor members, exterior wall members, and interior wall members. Preferably, each building assembly unit 60, 61, 160 is installed on support frame 50 having its respective first planar member/floor member 62, 162 lined up adjacent the first planar member/floor member 62, 162 of an adjacent or proximate building assembly unit 60, 160. A proximate building assembly unit may be at a different elevation to define a loft, sunken room or other split level effect.

Figure 9:
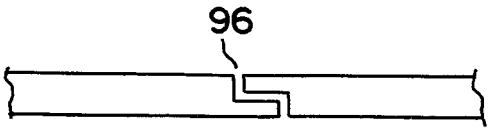
FIG. 9 is a partial view of a means for connecting floor members and wall members of adjacent units.
Figure 10:
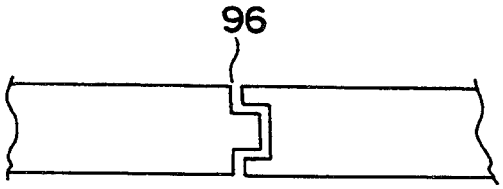
FIG. 10 is a partial view of another means for connecting floor members and wall members of adjacent units.
Figure 11:
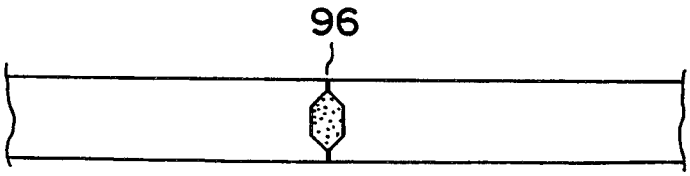
FIG. 11 is a partial view of yet another means for connecting floor members and wall members of adjacent units.
Figure 12:
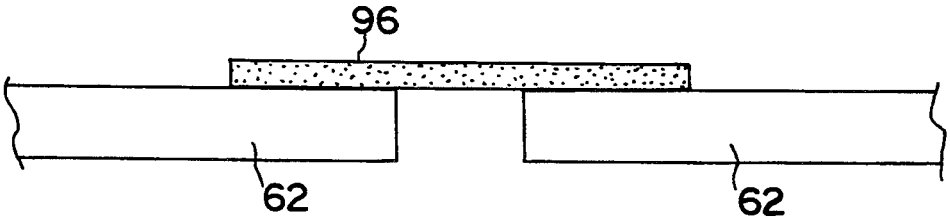
FIG. 12 is a partial view of a means for connecting floor members and wall members of units which are proximate one another.

In accordance with the invention, connecting means are provided for connecting each building assembly unit to an adjacent or proximate building assembly unit. Connecting means may include a mechanical union. As broadly embodied herein, mechanical union 96 may include any conventional union. As embodied in FIG. 9, a preferred mating union 96 is a conventional ship lapped union. Other mating unions, such as a tongue and groove connection, shown in FIG. 10, a grouted plug, shown in FIG. 11, a lapped or overlayed surface, shown in FIG. 12, or other unions are within the scope of the invention.

Figure 13:
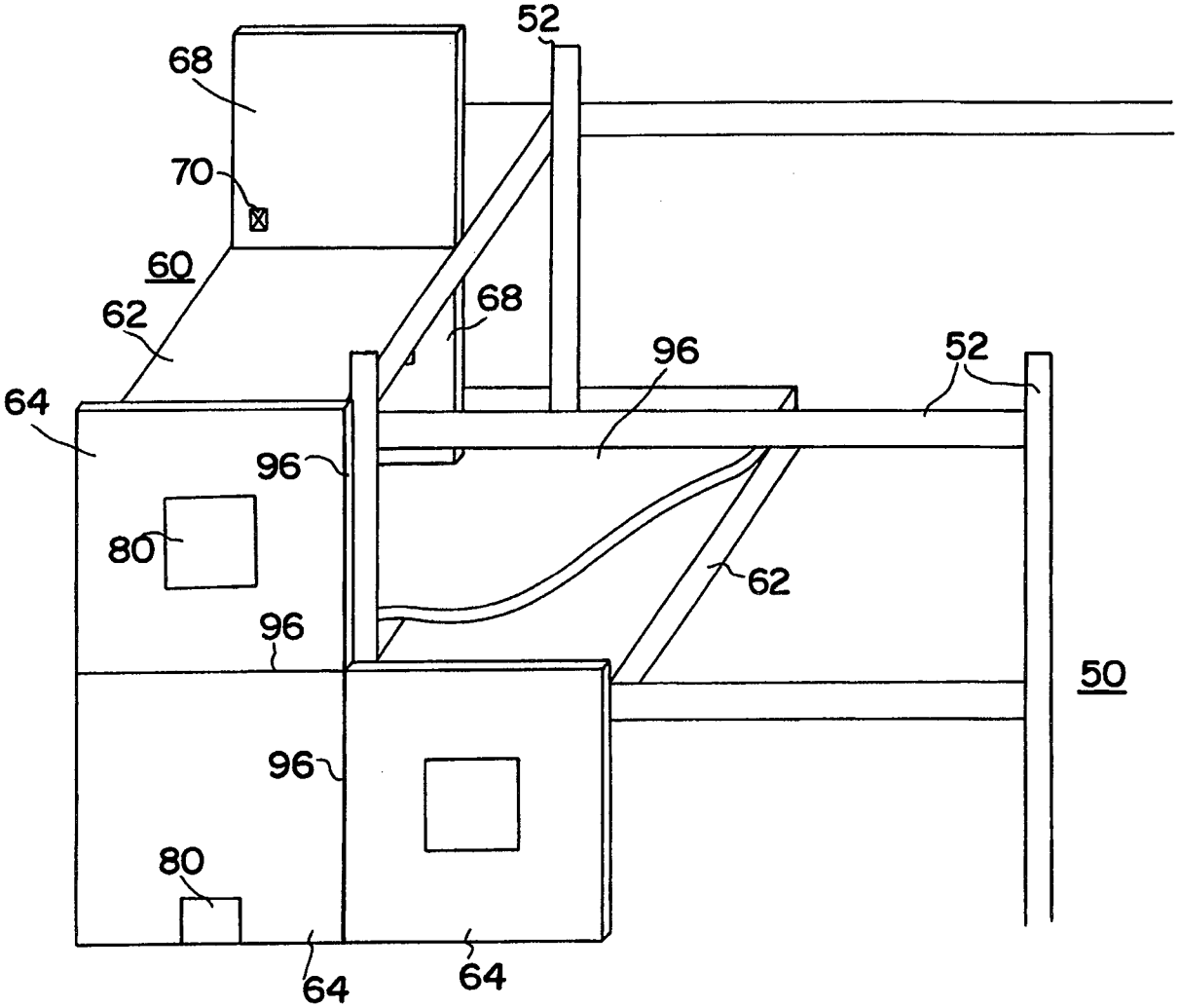
FIG. 13 is a partial detailed perspective view of a multi-story building including a support structure and a plurality of building assembly units according to the present invention.

It is further preferable that the connecting means connect both adjacent or proximate first planar members/floor members and adjacent or proximate second planar members/wall members. As embodied in FIG. 13, mechanical union 96, in this case a concrete slab, is placed or poured across and connects adjacent first planar members/floor members 62, providing a rigid diaphragm in the plane of the floor members. Similarly, FIG. 13 shows mechanical union 96, in this case a ship lap configuration, connecting each adjacent second planar member/wall members 64.

In accordance with the invention, the support structure may be a multi-story or high rise support structure. As embodied in FIG. 13, support frame 50 has several stories. Building assembly units 60 are installed adjacent one another both horizontally and vertically. In the high rise configuration, each first planar member 62 doubles as both a floor member for the story above, and a ceiling member for the story below. Second planar member 64 and third planar member 68, which can be pivotably attached to either surface of first planar member 62, can pivot downwards to form a wall member of the story below, or upwards to form a wall member of the story above.

In accordance with the invention, the building is assembled as follows. The building assembly units are prepared off-site, preferably in a factory. As embodied herein, each building assembly unit includes a first planar member and at least one second planar member. In one embodiment, second planar member 64 is pivotally connected at an edge of first planar member 62. In another embodiment, second planar member 65 is pivotally connected intermediate two edges of first planar member 62. In yet another embodiment, an internal wall second planar member 164 is pivotably connected intermediate two edges of first planar member 162. Third planar member 68 may also be connected intermediate two edges of first planar member 62, and on either or both surfaces.

Preferably, each building assembly unit is completely prefabricated at the factory. Electrical wiring, plumbing, ventilation ducts, and the like can be installed to various levels of completion. Windows, doors, balconies, stairways, and other desired functional and aesthetic amenities can be assembled and installed.

In accordance with the invention, the building assembly units are prepared for transportation to the construction site. Because of the pivotable connection of the planar members, each building assembly unit 60, 61, 160 can be folded with first and second planar members in parallel abutment with one another. Thus, the building assembly units are compact and can be shipped easily and in bulk.

A support structure 50 can be separately provided. The support structure may include a frame of framing members 52, or any other related structure.

In accordance with the invention, the building assembly units are installed upon the support frame with the first planar members either horizontally or on an incline to define a floor member. Second and third planar members pivot away from the first planar member to define a plurality of wall members. As embodied herein, second planar members 64 and 65 comprise exterior wall members, whereas second planar members 164 and third planar members 68, 168 comprise interior wall members. As embodied in FIG. 13, first planar members/floor members 62, 162, supported by framing members 52 are configured to be load bearing. Second planar members/wall members 64, 65, and third planar members 68, 168, may be load bearing, or may only be non-load-bearing curtain walls.

In accordance with the invention, the building assembly units are connected to the support frame. Preferably, first planar members/floor members 62 are mechanically joined to framing members 52 via mechanical unions 90. Additionally, second planar members/wall members 64, 65 may be mechanically joined to framing members 52 via mechanical unions 92. Second planar members/wall members 64, 65 can be joined to first planar members/floor members 62 via mechanical unions 94.

Preferably, adjacent and proximate building assembly units are connected with connecting means. Such connecting means include mechanical unions 96.

Because of the unique construction of the building assembly units, including the pivotal connection of the various planar members, the invention solves several problems previously existing in the construction industry. The installation of electrical means, ventilation means, doors, windows, etc. in the factory eliminates the need for skilled labor at the construction site. The ability of the planar members to fold up into compact parallel planes enables a large number of the building assembly units to be transported to the construction site easily and inexpensively, with reduced shipping volume. The folded configuration reduces on-site storage. Since each building assembly unit unfolds to form a floor member and exterior and interior wall members, relatively few lifts of the construction crane are necessary to put the building assembly units in place and erect the building. The increased speed with which such an assembly occurs minimizes construction time. Connecting the building assembly units to the support structure provides structural integrity. Finally, since the support structure and floor members take the load, a single-story, multi-story and even a high rise building may be constructed efficiently and less expensively, which was not possible using prior systems building assemblies and techniques.

Additional advantages and modifications will readily occur to those skilled in the art. The invention in the broader aspects is, therefore, not limited to the specific details and illustrative example shown and described. Accordingly, departures may be made from such details without departing from the spirit or scope of the applicant's general inventive concept.

What is claimed is:

1. An assembly for constructing a building, comprising:

a multi-story support frame;

a plurality of building assembly units, each unit including a first generally rectangular first planar member having opposite surfaces and opposite edges, installable upon the support frame to define a floor member, and a generally rectangular second planar member having opposite surfaces and opposite edges, pivotably attached to said first planar member at a position proximate one edge of said first planar member, and on one said surface intermediate two opposite edges of said second planar member, said second planar member disposed to pivot away from said first planar member to a generally vertical position to define a non-load bearing wall member; and means for connecting said building assembly units to the multi-story support frame.

2. An assembly according to claim 1, wherein at least one of said first and second planar members include means for supplying electricity.

3. An assembly according to claim 1, wherein at least one of said first and second planar members include means for supplying ventilation.

4. An assembly according to claim 1, wherein at least one of said first and second planar members include means for supplying plumbing.

5. An assembly according to claim 1, wherein at least one of said first and second planar members include means for providing access through said planar members.

6. An assembly according to claim 1, wherein said first and second planar members are further configured to pivot with one surface of said first planar member in parallel abutting relationship with one surface of said second planar member prior to installation in the support structure.

7. An assembly according to claim 1, wherein at least one unit further includes a generally rectangular third planar member pivotally attached at one edge to a position on one surface and intermediate two opposite edges of the respective first planar member, said third planar member disposed to pivot to a generally vertical position to define a wall member.

8. An assembly according to claim 1, wherein said connecting means include means for connecting at least one of said floor members to the support structure.

9. An assembly according to claim 1, wherein said connecting means include means for connecting at least one of said wall members to the support structure.

10. An assembly according to claim 1, further including means in at least one unit for connecting said respective wall member to said respective floor member.

11. A method of constructing a building, comprising steps of:

providing a plurality of building assembly units, each said unit including a generally rectangular first planar member having opposite surfaces and opposite edges, and a generally rectangular second planar member pivotably connected proximate one edge of said first planar member at a position on one surface intermediate two opposite edges of said second planar member;

installing each said unit on a multistory support frame with said first planar member supported by the support frame to define a floor member, and pivoting said second planar member away from said first planar member to define a non-load-bearing wall member, each unit being proximate another unit with proximate floor members and proximate wall members; and connecting each said unit to the multistory support frame.

12. The method of claim 11, further including a step of connecting each said unit to its respective proximate unit.

13. The method of claim 11, wherein the step of providing the units includes providing means for supplying electricity in at least one of said first and second planar members.

14. The method of claim 11, wherein the step of providing the units includes providing means for supplying ventilation in at least one of said first and second planar members.

15. The method of claim 11, wherein the step of providing the units includes providing means for supplying plumbing in said first and second planar members.

16. The method of claim 11, wherein the step of providing the units further includes providing means for providing access through the first and second planar members.

17. The method of claim 11, wherein the step of providing the units include for each unit pivoting the respective first and second planar members with one surface of said respective first planar member in parallel abutting relatively with one surface of said respective second planar member, and transporting each said unit to the multistory support frame.

18. The method of claim 11 wherein the step of installing the units includes installing one of said units on a first story proximate another of said units on the first story, and installing a second one of said units on a second story proximate yet another unit on the second story.

19. The method of claim 11, wherein the step of installing the units further includes for at least one unit rigidly joining the respective wall member to the respective floor member after the respective second planar member is pivoted away.

20. An assembly for constructing a building, comprising:

a multi-story support frame;

a plurality of building assembly units, each unit including a generally rectangular first planar member having opposite surfaces and opposite edges, installable upon the multi-story support frame to define a floor member, and a generally rectangular second planar member having opposite surfaces and opposite edges, pivotably attached to said first planar member, said second planar member disposed to pivot away from said first planar member to a generally vertical position to define a non-load-bearing wall member; and means for connecting said building assembly units to the multi-story support frame.

21. An assembly for constructing a building, comprising:

a multi-story support structure;

a plurality of building assembly units, each unit including a generally rectangular first planar member having opposite surfaces and opposite edges, installable upon the multi-story support structure to define a floor member, and a generally rectangular second planar member having opposite surfaces and opposite edges, pivotably attached to said first planar member, said second planar member disposed to pivot away from said first planar member to a generally vertical position to define a wall member; and means for connecting said building assembly units to the multi-story support structure.

22. A method of constructing a building, comprising the steps of:

providing a plurality of building assembly units, each said unit including a generally rectangular first planar member having opposite surfaces and opposite edges, and a generally rectangular second planar member pivotably connected proximate one edge of said first planar member at a position on one surface intermediate two opposite edges of said second planar member;

installing each said unit on a multistory support structure with said first planar member supported by the support structure to define a floor member, and pivoting said second planar member away from said first planar member to define a wall member, each unit being proximate another unit with proximate floor members and proximate wall members; and connecting each said unit to the multistory support structure.

* * * * *